US008714450B2

(12) United States Patent
Arnao et al.

(10) Patent No.: US 8,714,450 B2
(45) Date of Patent: May 6, 2014

(54) SYSTEMS AND METHODS FOR TRANSACTIONAL BALLOT PROCESSING, AND BALLOT AUDITING

(75) Inventors: Frederico Arnao, Oakland, CA (US); Eric Coomer, Broomfield, CO (US); Larry Korb, Moraga, CA (US); Josh Maletz, Oakland, CA (US)

(73) Assignee: Dominion Voting Systems, Inc., Denver, CO (US)

( * ) Notice: Subject to any disclaimer, the term of this patent is extended or adjusted under 35 U.S.C. 154(b) by 0 days.

(21) Appl. No.: 13/092,600

(22) Filed: Apr. 22, 2011

(65) Prior Publication Data

US 2012/0061468 A1 Mar. 15, 2012

Related U.S. Application Data

(63) Continuation of application No. PCT/US2009/061493, filed on Oct. 21, 2009.

(60) Provisional application No. 61/193,062, filed on Oct. 24, 2008.

(51) Int. Cl.
*G07C 13/00* (2006.01)

(52) U.S. Cl.
USPC ..... 235/386; 705/12; 235/51

(58) Field of Classification Search
USPC ..... 235/51–57, 386; 705/12
See application file for complete search history.

(56) References Cited

U.S. PATENT DOCUMENTS

2002/0084325 A1* 7/2002 Reardon ..... 235/386
2007/0170253 A1* 7/2007 Chung et al. ..... 235/386

* cited by examiner

*Primary Examiner* — Kristy A Haupt
(74) *Attorney, Agent, or Firm* — Holland & Hart LLP

(57) ABSTRACT

A voting unit and a ballot transaction processing system for processing a voting session. The voting unit includes an optical ballot scanner and a printer that is capable of printing a non-human readable barcode on ballots that are fed into the voting unit. The ballots are filled out (or cast) by the voter before being inserted into the voting unit. The voter can confirm the voting unit's interpretations of his/her selections on the scanned ballot via a display and confirm that the interpretations are correct via an input section on the voting unit. The ballot transaction processing system is also capable of generating, assigning and communicating to a plurality of voting units a set of unique transaction codes. In so doing, the ballot transaction processing system maintains voter secrecy, prevents ballot stuffing and provides a one-to-one correspondence between images of optically scanned ballots and the ballots themselves.

14 Claims, 5 Drawing Sheets

SYSTEMS AND METHODS FOR TRANSACTIONAL BALLOT PROCESSING, AND BALLOT AUDITING

This application is a continuation of international application PCT/US09/61493, filed Oct. 21, 2009, which claims the benefit of U.S. Provisional Application No. 61/193,062 filed Oct. 24, 2008. The disclosures of which are hereby incorporated herein by reference in their entirety.

BACKGROUND

In the technology of ballot transaction processing, it is desirable to develop apparatus and methods for processing paper ballots, such as by optically scanning or optically reading those ballots, in a more efficient and reliable manner. The improvements described herein relate to technologies for processing ballots, tabulating votes and in particular technologies for auditing all tally results from an optical scan-based ballot tabulator.

It is generally known to print certain identifying information on a ballot when the ballot is printed before an election. For example, U.S. Pat. No. 6,892,944 discloses providing on each ballot a voter registration number that can include a barcode, two-dimensional barcode, a prescribed font, optical character recognition characters, alphanumeric characters, non-alphanumeric characters and symbols. Further, this patent discloses that the voter registration number can include information such as the voter's state, county, precinct etc. in addition to a randomly generated number that is printed on the ballot prior to election. However, this pre-printed information violates voter secrecy and does not prevent ballot stuffing or provide an adequate one-to-one correspondence between images of optically scanned ballots and the ballots themselves.

There are numerous voting technologies known that are directed to permitting votes to be cast and recorded efficiently while maintaining the secrecy of the ballot.

Of paramount importance in an election process is the efficient verification and auditing of voting results. One of the obstacles associated with the verification is that there is usually a subjective determination made when determining the voter intent. For example, in the case of mechanical based systems that punch out a hole in a ballot, subjective determinations have had to be made in well-publicized cases to determine the voter intent with respect to partially attached chads. These subjective determinations lead to inconsistent results and have a negative impact on public perception of vote integrity. Therefore, it is desirable to provide a ballot processing system that objectively determines voter intent in a consistent and reliable manner and that provides a mechanism for auditing the results on a vote-by-vote basis.

Of equal importance is a process of tracking the transaction of a ballot while the vote is being reviewed prior to casting. To this end, various systems have been developed to track the voting process. However, these systems can be susceptible to tampering. Therefore, it is desirable to develop a more efficient and secure means of tracking a ballot transaction.

While many systems provide for auditing vote totals and recounting results, it is desirable to provide a more secure, efficient audit process that can audit an individual vote across all records of this vote including the paper ballot, the electronic record of the cast vote, and the digital image of the ballot.

SUMMARY

In view of the above issues, the following improvements are presented.

One improvement relates to a voting unit including an optical ballot scanner and a printer that is capable of printing a non-human readable barcode as well as human readable characters on ballots that are fed into the voting unit. The ballots will have been filled out (or cast) by the voter before being inserted into the voting unit, and thus before having the barcode and/or human readable characters printed on it by the printer. The barcode and/or human readable text is only printed on the ballot after the voter has cast the ballot (that is, after the voter has accepted the voting unit's interpretation of the voter's selections made on the ballot).

The improvement also relates to an election preparation system capable of generating, assigning and communicating to a voting unit a set of unique, randomly generated transaction codes.

Some benefits of this improvement are as follows. The election preparation system pre-allocates a set of unique transaction numbers to be used by each voting unit. Ballot processing is done via session transactions where ballots consisting of multiple sheets are logically associated with each other. This allows the system to accurately determine the number of ballots cast, and the true voter turnout independently of the number of ballot cards processed. This system prevents ballot stuffing by ensuring that only ballot image records with valid ballot image identifiers matching those pre-assigned to the associated precinct/voting unit are tallied. Therefore, 'Stuffed' ballots that do not match the pre-allocated set of unique transaction numbers will be rejected and flagged for investigation. This system allows the entire lifecycle of a cast ballot from time of casting to tabulation to be monitored and audited. This system also allows the captured images of ballots to be used for post processing and auditing and to be accurately correlated with the associated physical ballot where necessary, in a verifiable manner. In addition, according to some embodiments, the proposed method does not assign the ballot identification number to a ballot until after the ballot has been cast, thus preserving the secrecy of the ballot. Finally, the application of the ballot identification number effectively "cancels" the cast ballot thus preventing the same ballot from being counted more than once.

The ballot transaction processing system described herein includes, for example, a voting unit having an optical ballot scanner, and an election preparation system configured to generate, assign and communicate to the voting unit a set of randomly generated transaction codes. Each voting session (each time a voter inputs the voter's ballot) that is processed by the voting unit can be assigned a ballot sheet identifier that includes at least a number identifying the particular ballot and a unique transaction number. The unique transaction number can be randomly selected from a pre-assigned list of numbers assigned to that voting unit for that election by the election preparation system. The voting unit preferably also includes a printer. The printer prints one or both of a non-human readable code and human readable characters on ballots that are fed into the voting unit after the ballot has been read by the voting unit and then accepted by a voter. The printer can print a non-human readable code on the ballot representing the assigned ballot sheet identifier. Further, a verification portion can be provided in the voting unit that can read and verify that the assigned ballot sheet identifier has been correctly printed onto every ballot fed into the voting unit. The voting unit includes a display that displays information related to the selections marked on the ballot by the voter after the optical ballot scanner scans the ballot. The voting unit also includes an input section configured to allow the voter to accept or reject the selections marked on the ballot based on the information displayed on the display.

In another aspect of the ballot transaction processing system, the pre-assigned list of numbers can be encrypted.

In a further aspect of the ballot transaction processing system, if the ballot is read by the voting unit but is then rejected by the voter (for example, because the voter disagrees with the voting unit's interpretation of the voter's ballot selections), the printer can print a non-human readable code on the ballot representing the assigned ballot sheet identifier plus a code indicating that the ballot has been rejected and human readable indicia (such as the word "canceled") indicating that the ballot was rejected.

In yet another aspect of the ballot transaction processing system, the voting unit can read and verify that a printed barcode representing an assigned ballot sheet identifier and rejection condition is correctly printed onto the ballot.

In an additional aspect of the ballot transaction processing system, all scanned images, and electronic "Cast Vote Records" of the ballot can be associated with the assigned ballot sheet identifier, thereby providing a one-to-one correlation between the ballot images and the physical ballots.

In a further aspect of the ballot transaction processing system, ballots already having an assigned ballot sheet identifier cannot be inserted by a voter and re-scanned and tabulated by the optical ballot scanner.

In an additional aspect of the ballot transaction processing system, the ballot transaction processing system can further include a tabulation system that only accepts ballot image records that have ballot image identifier codes that match the codes pre-assigned to an associated precinct/voting unit by the election preparation system.

Another aspect includes a method of processing a voting session of a voter. The method includes: scanning a ballot after a voter has marked his/her selections on the ballot; displaying information related to the selections marked on the ballot by the voter after scanning the ballot; prompting the voter to either accept or reject the selections marked on the ballot based on the displayed information; and printing a unique code on a ballot having election-choice-information printed thereon after the ballot has been cast and accepted by the voter.

Additionally, after printing the unique code on the ballot, the ballot can be rescanned to produce an image of the ballot with the unique code printed thereon.

The method of processing a voting session of a voter can also include generating three separate records of each ballot including the ballot having the unique code printed thereon, the image of the ballot and the unique code, and results information related to the ballot including the unique code.

Yet another aspect includes a method of processing a voting session of a voter, the method including: assigning to a cast ballot a unique transaction number that is randomly selected from a list of numbers assigned to a voting unit for an election; printing a non-human readable code such as a barcode on the ballot after the ballot has been read by the voting unit and after the read ballot has been accepted by the voter (that is, after the voter has accepted the voting unit's interpretation of the ballot); scanning the printed barcode on the ballot; reading the printed barcode on the ballot; verifying that the printed barcode has been correctly printed on the ballot; associating the unique transaction number with all of the records associated with the cast ballot, including in the digital image of the ballot, and in an electronic record of the ballot; tabulating the ballot and other ballots that have valid transaction numbers and importing the transaction numbers into an election management system.

BRIEF DESCRIPTION OF THE DRAWINGS

The foregoing and further objects, features and advantages of the apparatus and methods described herein will become apparent from the following descriptions of exemplary embodiments with reference to the accompanying drawings, in which like numerals are used to represent like elements and wherein.

DETAILED DESCRIPTION

Ballot Transaction Processing

Figure 1:
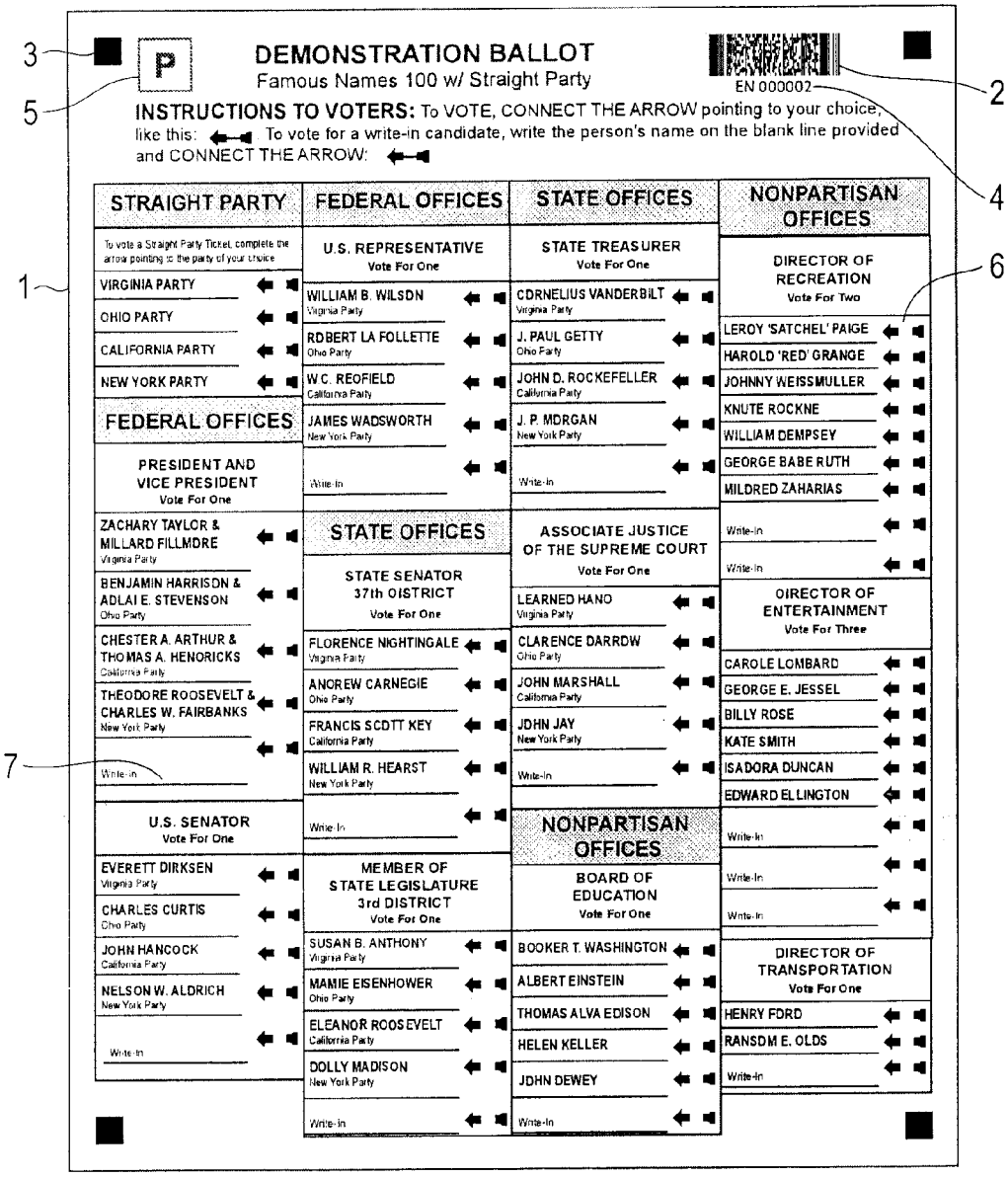
FIG. 1 is a diagram illustrating an example of a ballot.

FIG. 1 illustrates an example of a ballot 1. The ballot 1 can be, for example, 4.25 inches or 8.5 inches wide and from 11 inches to 22 inches in length. In one embodiment illustrated in FIG. 1, the ballot 1 has ballot registration marks 3 which are solid black 0.25 inch squares located just inside of a 0.25 inch unprinted area, bounding all sides of the ballot 1. Where the ballot 1 is longer than 11 inches, additional registration marks are desirable and can be provided.

Figure 2:
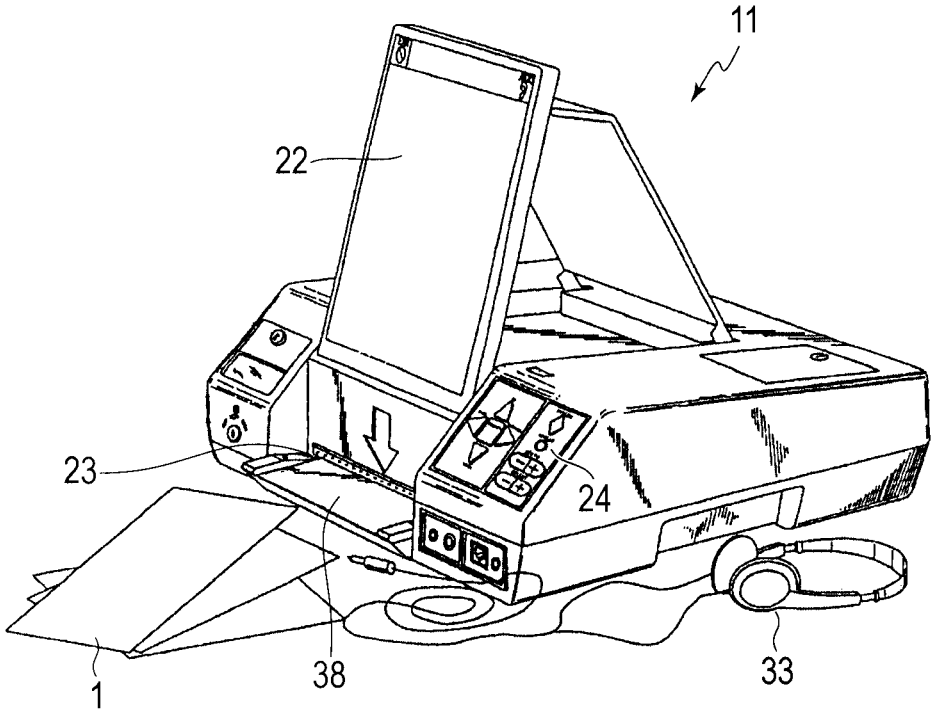
FIG. 2 is a diagram illustrating an example of a voting unit.
Figure 3:
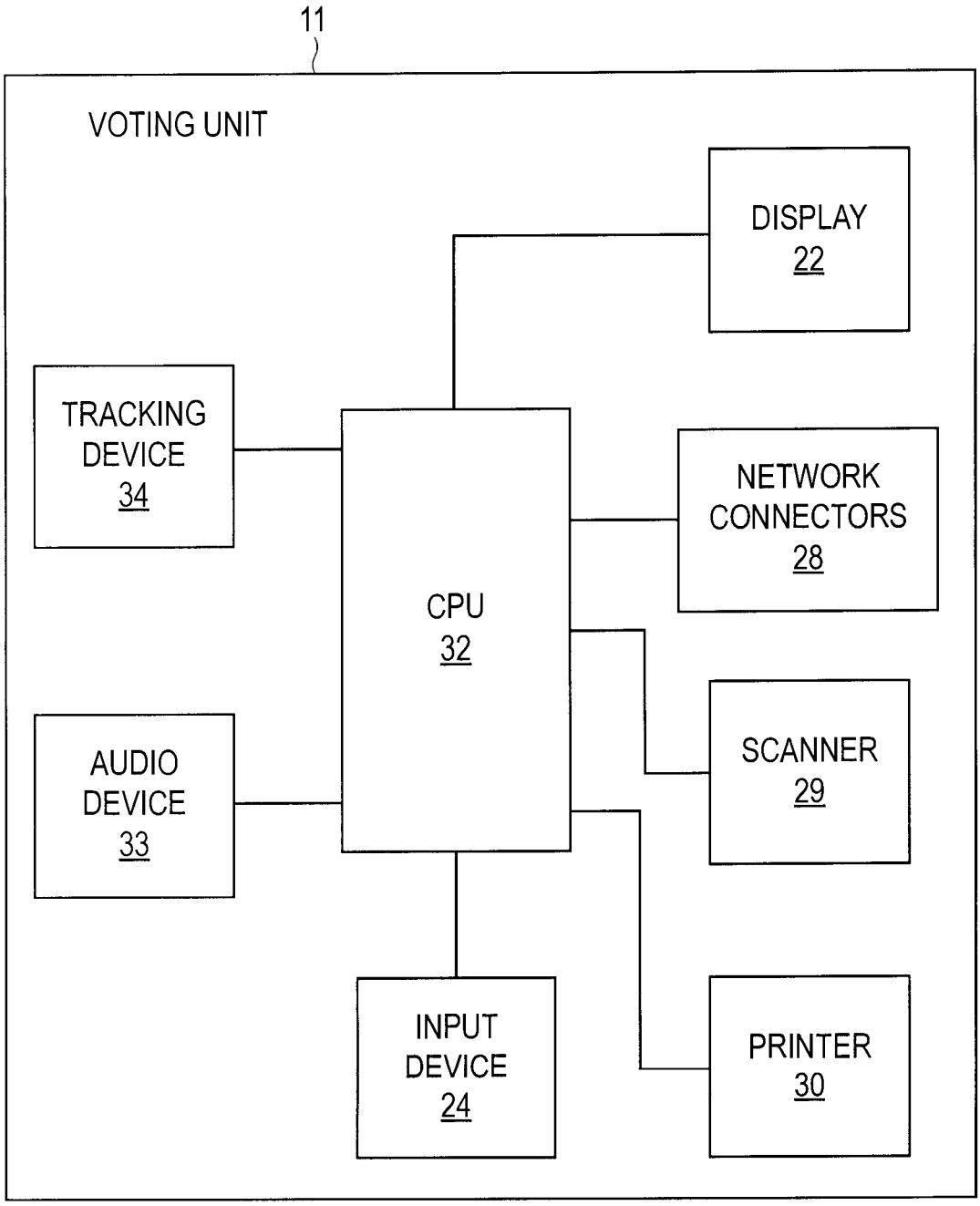
FIG. 3 is a diagram illustrating some of the components of a voting unit.

FIG. 2 illustrates an example of a voting unit 11 that can be an optical ballot scan device. As seen from FIG. 2, voting unit 11 can include an input slot 23 into which a ballot 1 to be scanned is fed, a ballot feed tray 38, a display 22, an audio device 33, and a user-manipulatable input device 24. FIG. 3 illustrates some of the components that can be included in each voting unit 11. The voting unit 11 can include a CPU 32 that controls operation of the unit 11 including the functions described herein, a tracking device 34, an audio device 33, an input device 24, an optical scanner 29, a printer 30, network connectors 28 and a visual display unit 22. Voting unit 11 is not limited to these specific components as any number of other components known to one of ordinary skill in the art for inclusion on voting units could be incorporated therein.

After a voter fills-in a ballot, the voter inserts the completed ballot into the slot 23 of the voting unit 11. The voting unit 11 then optically scans the ballot with its internal scanner 29, which can be a CCD scanner, for example. An image of the scanned ballot then can appear on the display 22. By viewing the image, the voter can confirm that the ballot image is correct. In addition, by using image recognition/processing technology (see, for example, U.S. Pat. No. 6,854,644, the disclosure of which is incorporated herein by reference in its entirety), the voting unit 11 determines the selections made by the voter on the ballot (i.e., determines which candidates, etc. were selected by the voter) and displays those determined selections to the voter via display 22. The user can then confirm that the voting unit's determinations are correct, and if correct, accept the voting unit's determinations via input device 24.

Figure 4:
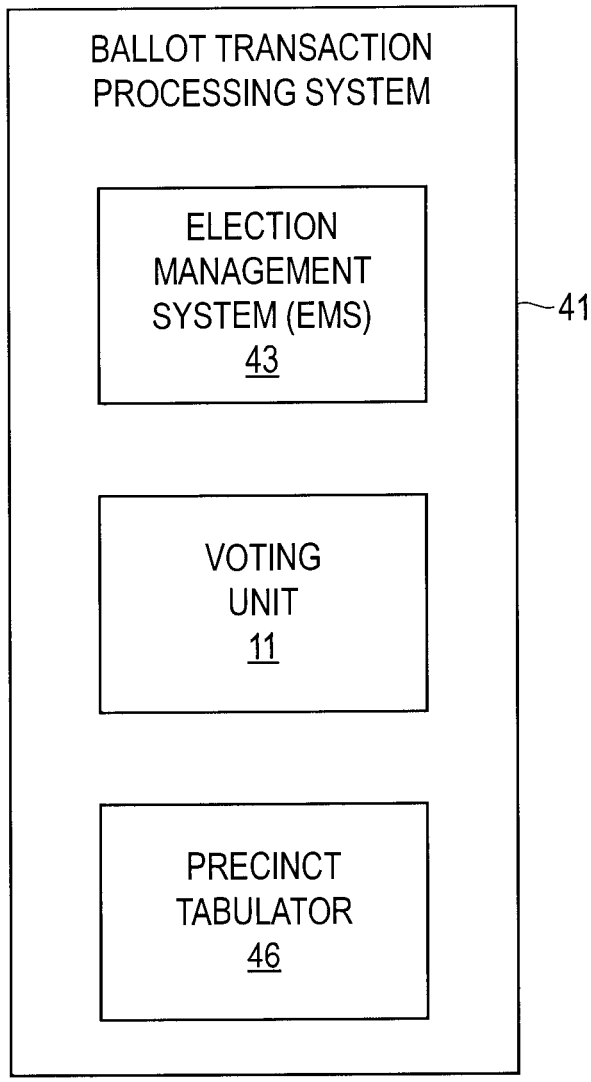
FIG. 4 is a diagram illustrating some of the components of a ballot transaction processing system.

FIG. 4 illustrates some of the features that can be included in a ballot transaction processing system 41. The ballot transaction processing system 41 can include, for example, an Election Management System (EMS) 43, a voting unit 11 and a precinct tabulator 46.

The precinct tabulator 46 may or may not be provided in the voting unit 11. Each voting unit 11 is a tabulator in that each voting unit 11 consolidates the votes cast on the voting unit 11 at the end of the night to create a machine results report. In addition, there may be a secondary precinct tabulator/consolidation unit that consolidates and tabulates the results from "several" voting units 11. Further, the EMS also acts as a "central" tabulation and accumulation system consolidating all of the results from all of the precinct tabulators 46 in the election.

Figure 5:
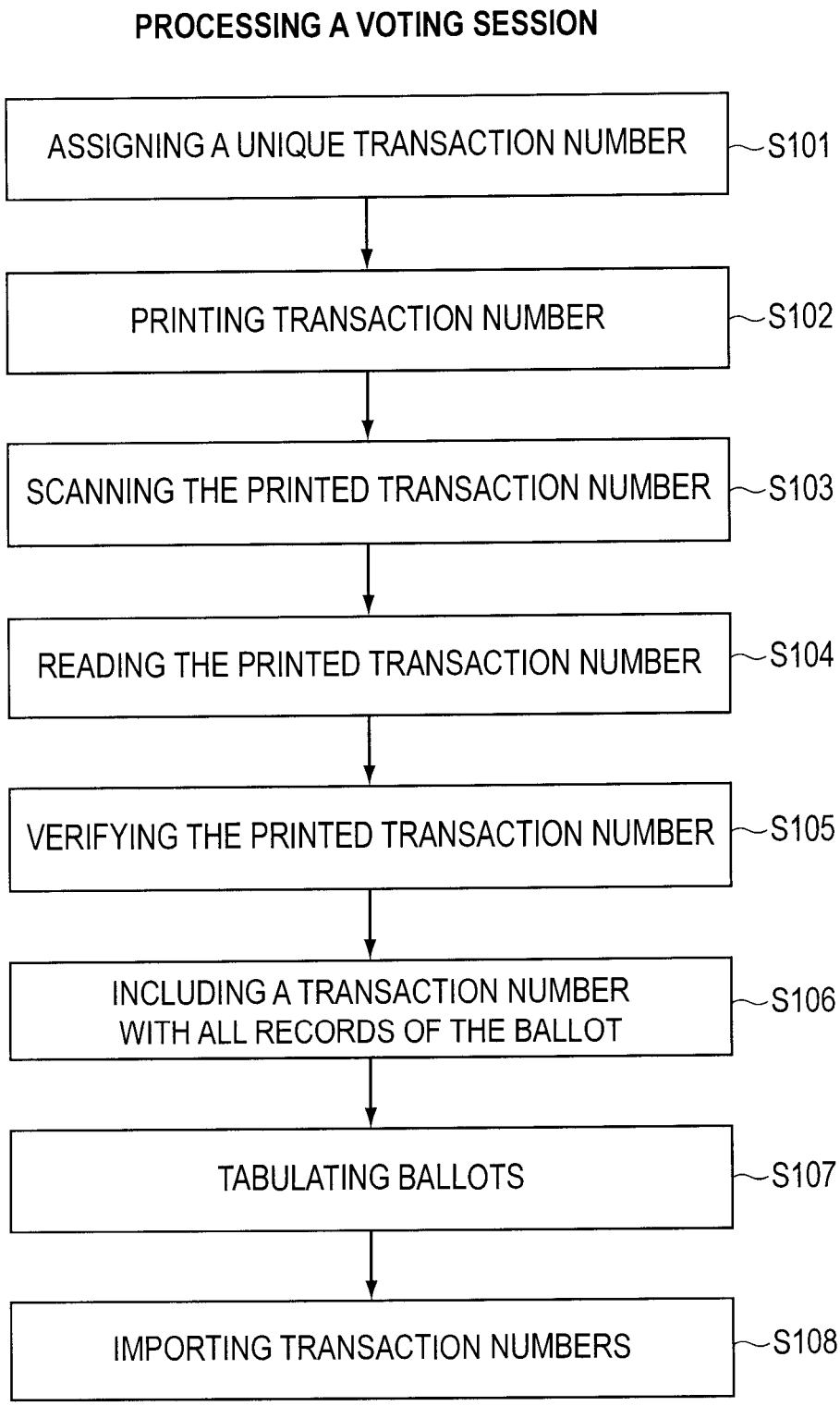
FIG. 5 is a flowchart illustrating some of the steps of a method for processing a voting session of a voter.

FIG. 5 is a flowchart illustrating a method of processing a voting session of a voter.

Each voting session (that is, a voter's set of selections for the ballot 1) processed by the voting unit 11 is assigned a unique transaction number (S101 of FIG. 5) that is randomly selected from a pre-assigned list (set) of numbers assigned to that voting unit 11 for that election after the voter accepts the voting unit's determinations regarding the ballot. The pre-assigned list of numbers may be encrypted to prevent spoofing. When a ballot 1 has been read (optically scanned) by the scanner 29 of the voting unit 11 and then accepted by the voter, the printer 30 of the voting unit 11 prints (S102 of FIG. 5) a non-human readable barcode 2 (for example) on the ballot 1 representing the assigned transaction number (see FIG. 1). The optical ballot scanner 29 of the voting unit then again scans, reads and verifies (S103, S104, S105 of FIG. 5) that the printed barcode 2 has been correctly printed onto the ballot 1. The scanned portion of the ballot with the barcode 2 is appended to the previously scanned (pristine) image of the ballot 1. The electronic cast vote record recorded by the tabulator associated with this ballot is also assigned this transaction code. The electronic cast vote record is a file indicating the voter's candidate (and/or other) selections as interpreted by the voting unit 11 and accepted by the voter.

Assigning/printing (S106 of FIG. 5) the same transaction number (also called "transaction code") to all stored records provides a mechanism for tying all 3 independent records of the ballot 1 directly to one another including the physical ballot 1 (including the printed transaction code 2 on the ballot 1), digital image of the ballot (scanned ballot 1 with the printed transaction code 2), and the electronic record (assigned transaction code).

To ensure that each ballot 1 is tabulated only one time, the optical ballot scan device will not re-scan and tabulate ballots that already have a transaction code printed on the ballot 1 when the ballot was inserted into the slot 23. This provides one mechanism for preventing 'ballot stuffing'.

Further, the tabulation system 46 that tabulates (S107 of FIG. 5) the ballots 1 only accepts ballot results (ballot image records) that have ballot image identifier codes that match the ballot image identifier codes pre-assigned to the associated precinct/voting unit 11 by the election preparation system. This provides another mechanism for preventing 'ballot stuffing'.

Finally, all of the assigned transaction codes can be imported (S108 of FIG. 5) into the Election Management System (EMS) (describe below) after the election day tallies have been completed. During audits and recounts of the results, it is possible to ensure that every ballot that was cast and assigned a transaction code on election day is counted during the audit or recount. Any discrepancies during a recount due to ballots 1 being altered, or due to marginal marks can be identified on a ballot-by-ballot and vote-by-vote basis by comparing the tallied results from election day and during the recount using the transaction codes assigned to the ballot. In addition, the transaction code prevents the same ballot 1 from being counted more than once during recounts and audits as well.

Election Management System

The programming of each voting unit 11 can be accomplished through the use of the EMS 43. When the EMS 43 creates an election definition for a voting unit 11 or creates a mechanism for programming a voting unit 11 (whether through a cartridge or through programming directly over a network), the EMS 43 generates a set of voting transaction numbers to be associated with that voting unit 11 such that the total number of allocated voting transaction numbers will exceed the number of predicted registered voters for that precinct. The transaction numbers can consist of, for example, an election identifier, a precinct identifier (or an early vote identifier) and an additional number. There are a number of approaches that can be taken to allocating these additional numbers. This set of assigned numbers will be unique across the entire election, and can even be unique across multiple elections and jurisdictions if jurisdiction specific identifiers are included.

One approach is that at the time of election definition, the EMS 43 will create a set of these numbers considerably larger than the predicted number of registered voters in the jurisdiction. These numbers could form a continuous set or be randomly generated. The EMS 43 allocates these numbers randomly to the set of allocated session numbers for a voting unit 11 during the election/cartridge creation process for that voting unit 11. Another approach is for the EMS 43 to generate a set of random numbers to be used during the election/cartridge creation process for that voting unit 11, where the size of the set is larger than the predicted number of registered voters for the precinct to which the unit is allocated.

Regardless of which approach is used, the EMS 43 assigns a set of unique transaction numbers to each voting unit 11, and provides the voting unit 11 with that set along with its election definition.

When a voter initiates a voting session on a voting unit 11 (for example, by inserting a completed ballot 1 into the slot 23 of the voting unit 11), the voting unit 11 randomly selects one of the transaction numbers that have been pre-allocated to identify the voting session transactions. Each number will only be allocated once, ensuring that each transaction number allocated is unique to that voting session.

If the voting unit 11 includes an optical ballot scanner 29 and the ballot 1 consists of more than one sheet, then each sheet will be assigned the same ballot transaction code (transaction number). This allows the system to determine the true voter turnout regardless of the number of sheets that a given voter casts (sometimes voters do not complete all sheets).

The voting unit 11 also includes a printer 30 disposed therein, which is capable of printing a barcode onto the ballot sheet 1. The optical ballot scanner 29 of the voting unit 11 is also capable of reading and decoding barcodes, including barcodes that the voting unit 11 has printed onto a ballot sheet 1.

When the voting unit 11 processes a ballot sheet 1 (and after the voter accepts the voting unit's determination of the voter's selections), the printer 30 prints the transaction number, in the form of a barcode, onto the ballot sheet 1. This ballot imprinter (the printed information) is also capable of identifying counterfeit, fraudulent, or duplicated ballots as well by printing "Invalid" in the same fashion as the barcode may be printed on the ballot 1. After the printer 30 has printed the transaction code, the ballot scanner 29 rescans the ballot 1 to include the barcode in the ballot image and to verify that it has been printed correctly. When the voting unit 11 processes the ballot 1 and saves the votes detected and the images of the ballot 1, it will also save the transaction number assigned to the ballot 1.

If a voter inserts a ballot 1 which already has a barcode printed on it representing a transaction number into the slot 23 of the voting unit 11, the voting unit 11 will not process and tabulate that ballot sheet 1 because the bar-coded ballot sheet should have already been processed by that or another voting unit 11. This prevents a ballot 1 from being read and processed (and counted) multiple times.

When the polls have been closed and the results cartridge of a particular voting unit 11 is read into the tally system (precinct tabulator 46), the tally system checks each ballot image record and compares the transaction number to the list of transaction numbers assigned to that particular voting unit 11, to ensure that the voting unit 11 has correctly assigned transaction numbers to all of the records, and no records exist with incorrectly assigned transaction numbers. If a transaction number does not match the numbers assigned to that particular voting unit 11, the tally system will check the number against all the assigned transaction numbers. If there is no match, then the tally system does not tally that ballot image record and stores the ballot image record in a list (file or database) indicating that the ballot was not a valid ballot and not processed on a valid voting unit 11. If the transaction number is valid, but not for the voting unit 11 from which it was read, the tally system will not tally it and will store it in a list indicating that there is a possible issue, which can then be resolved later. The tally system can be a central tally/accumulation system, which is part of the EMS.

The tally system is also able to count the number of different transaction numbers that have been tallied. This accurately represents the number of voters that have cast ballots, irrespective of whether they cast all the ballot sheets when a ballot consists of multiple sheets.

The tally system also is able to accurately associate the captured digital image of the ballot 1 with the ballot record data including the transaction number. This feature assists in post-election auditing and ensures that the digital images can be verified against the physical ballots as well as the electronic cast vote records.

During an audit or recount, the recount results can be compared to the results from election day on a vote-by-vote basis utilizing the transaction codes assigned to each ballot. The recount machines can be configured to only accept ballots with transaction codes printed on them that match the transaction codes assigned to voting sessions on election day. After the recount is complete, any discrepancies can be tied back to a single voting session by comparing, on a vote-by-vote basis, the cast vote records from election day to the recount results. In addition, the system can be configured to allow each transaction code to be processed once during the recount, and at any time, the system can report any "missing" transaction codes from the recount that were assigned to ballots on election day.

Transaction Barcode/Ballot Imprinting System

The voting unit 11 employs a ballot imprinting device (printer 30) to both "cancel" and uniquely identify ballot cards after the cards have been processed and "cast" by the voter. The ballot imprinter can be, for example, an inkjet printer with a ⅛ inch wide print head. The barcode can then be printed along a ¼ inch margin along the side of the ballot card.

The main function of this system is to imprint a barcode 2 on the ballot 1 once the voter has verified, reviewed, and accepted the processed ballot results. The barcode 2 includes jurisdictional level identifying characteristics, as well as a randomly generated portion to uniquely identify each voter session. In addition, additional human readable characters can be printed along with the barcode. These characters will aid in manual separation of "exception" ballots; "exception" ballots are ballots that have been marked as having some type of error or rejection criteria. Human readable text can also be added to identify ballots that are counterfeit, duplicated, or otherwise fraudulent in nature.

The barcode 2 can use, for example, Code 128C encoding and contain, for example, a maximum of 10 codewords for a total of 20 numerical digits to form a transaction code. The format of the transaction code can be as follows:

MM-YY-ST-CNTY-N,NNN,NNN,NNN

MM: 2 digit Month

YY: 2 digit Year

ST: 2 digit FIPS "State" Code

CNTY: 3 digit FIPS "County" Code+1 extra digit

N: unique "Voter Session" number with maximum value 9,999,999,999

For example, in this embodiment, for an election conducted in San Francisco County, California in November, the jurisdictional barcode portion would be: 1108060075.

The Voter Session number serves a multitude of security and data related purposes. When the election is initiated, all number values are available from 1-9,999,999,999. Each voting device has a pool of these number values randomly assigned to the voting device at the time of initialization. The size of the pool will be dependent on the number of machines used in the jurisdiction. When a voting session is opened (voter introduces a ballot to the voting unit 11), a particular number value from among the pool will be assigned to the electronic record created for the processed ballot results. In addition, this value will be appended to the jurisdictional information described above and encoded into a barcode 2 that is imprinted on the ballot 1 once the ballot 1 has been cast. It is then possible to tie each electronic record and scanned image directly to the physical ballot 1 in the ballot box.

In addition, the voting unit 11 can be configured to automatically reject any ballot 1 that has already been imprinted with this identifying barcode. This prevents "stuffing" the ballot box as each ballot 1 can only be tabulated once because the ballot imprinting acts like a cancellation mark.

In addition, if there are multiple cards for a single ballot 1, the identifier is associated with the individual card records together at an individual voter level (i.e., the same identifier is printed on each card of a voter's multi-card ballot). This enables the tracking of true voter turnout, which is not possible with current paper-based scanning systems with multiple ballot cards. As these values are assigned randomly from a pre-assigned pool of values, there is no way to tie the identifier to a specific voter, thus ensuring complete voter privacy.

Finally, since a pool of identifying values are pre-assigned to each voting unit 11 and stored in encrypted files, the processed data can be compared after tally to ensure that all records have valid identifiers thus further improving the security and audibility of the results. At any time, the image scanned by the voting unit 11 and processed for the initial results can be compared to the physical ballot 1 cast by matching the identifier associated with the electronic record to the barcode 2 imprinted on the ballot 1.

The foregoing description is considered as illustrative only of the principles of the improvements discussed above. The inventions described herein are not limited to specific examples provided herein.

What is claimed is:

1. A method of processing a voting session of a voter, the method comprising:

assigning to a voter-marked paper cast ballot a unique transaction code that is randomly selected from a set of codes assigned to a voting unit for an election;

printing the unique transaction code on the voter-marked paper cast ballot after the cast ballot has been read by the voting unit and after the voting unit's interpretation of the cast ballot has been accepted by the voter;

scanning the unique transaction code printed on the cast ballot;

verifying that the printed unique transaction code has been correctly printed on the cast ballot;

including the unique transaction code with all records associated with the cast ballot;

tabulating the cast ballot and other cast ballots that have valid transaction codes; and importing the transaction codes into an election management system.

2. The method of claim 1, wherein the unique transaction code that is randomly selected from the set of codes assigned to the voting unit is encrypted.

3. The method of claim 1, wherein the printing the unique transaction code on the voter-marked paper cast ballot comprises printing a barcode on the voter-marked paper cast ballot.

4. The method of claim 1, wherein the unique transaction code printed on the voter-marked paper cast ballot is used only once for the voting session.

5. The method of claim 1, wherein the set of codes assigned to the voting unit are generated such that the total number of allocated transaction codes exceed the number of predicted registered voters for a particular precinct.

6. The method of claim 1, wherein the transaction code includes an election identifier, a precinct identifier and at least one additional number.

7. The method of claim 1, further comprising:

identifying counterfeit, fraudulent, or duplicate ballots; and marking the identified ballots as invalid.

8. A voting unit apparatus comprising:

a processor configured to assign to a voter-marked paper cast ballot a unique transaction code that is randomly selected from a set of codes assigned to the voting unit for an election;

a printer coupled to the processor and configured to print the unique transaction code on the voter-marked paper cast ballot after the cast ballot has been read by the voting unit and after the voting unit's interpretation of the cast ballot has been accepted by the voter;

a scanner coupled to the processor and configured to scan the unique transaction code printed on the cast ballot;

the processor further configured to:

verify that the printed unique transaction code has been correctly printed on the cast ballot;

save the unique transaction code with all records associated with the cast ballot;

tabulate the cast ballot and other cast ballots that have valid transaction codes; and import the transaction codes into an election management system.

9. The apparatus of claim 8, wherein the unique transaction code that is randomly selected from the set of codes assigned to the voting unit are encrypted.

10. The apparatus of claim 8, wherein the printing the unique transaction code on the voter-marked paper cast ballot comprises printing a barcode.

11. The apparatus of claim 8, wherein the unique transaction code printed on the voter-marked paper cast ballot is used only once for the voting session.

12. The apparatus of claim 8, wherein the set of codes assigned to the voting unit are generated such that the total number of allocated transaction codes exceed the number of predicted registered voters for particular precinct.

13. The apparatus of claim 8, wherein the transaction code includes an election identifier, a precinct identifier and at least one additional number.

14. The apparatus of claim 8, wherein the processor is further configured to identify counterfeit, fraudulent, or duplicate ballots and mark the identified ballots as invalid.

* * * * *